US006581807B1

(12) United States Patent
Mekata

(10) Patent No.: US 6,581,807 B1
(45) Date of Patent: Jun. 24, 2003

(54) AEROSOL PRODUCT

(75) Inventor: Satoshi Mekata, Ibaraki (JP)

(73) Assignee: Daizo Corporation, Osaka (JP)

( * ) Notice: Subject to any disclaimer, the term of this patent is extended or adjusted under 35 U.S.C. 154(b) by 0 days.

(21) Appl. No.: 10/048,153

(22) PCT Filed: Jul. 27, 2000

(86) PCT No.: PCT/JP00/05008

§ 371 (c)(1),
(2), (4) Date: Jan. 24, 2002

(87) PCT Pub. No.: WO01/89959

PCT Pub. Date: Nov. 29, 2001

(30) Foreign Application Priority Data

May 26, 2000 (JP) ..... 2000-156255

(51) Int. Cl.[7] ..... B65D 83/00
(52) U.S. Cl. ..... 222/402.1
(58) Field of Search ..... 222/402.1, 394

(56) References Cited

U.S. PATENT DOCUMENTS 5,527,577 A * 6/1996 Walters et al. ..... 222/402.1
5,894,958 A * 4/1999 De Laforcade ..... 222/402.1

FOREIGN PATENT DOCUMENTS

| | | |
|---|---|---|
| JP | 7-108148 | 4/1995 |
| JP | 7-241498 | 9/1995 |
| JP | 10-305879 | 11/1998 |
| JP | 11-300242 | 11/1999 |

* cited by examiner

*Primary Examiner*—Philippe Derakshani

(57) ABSTRACT

The present invention provides an aerosol product able to surely spray constant amount of an aerosol composition comprising powder. An aerosol container having a liquid storage part in a passage from the interior of the container body to a nozzle of an aerosol valve system and a valve shut out the liquid storage part from the interior of the container body with spraying operation.

4 Claims, 4 Drawing Sheets

AEROSOL PRODUCT

TECHNICAL FIELD

The invention relates to an aerosol product, particularly an aerosol product spraying quantitatively an aerosol composition comprising powder.

BACKGROUND ART

Aerosol products spraying quantitatively an aerosol composition comprising powder are disclosed, for example, in Japanese unexamined patent publications No. 1999-228943, and No. 1999-300242. Japanese unexamined patent publication No. 1999-228943 discloses an aerosol product, which quantitatively sprays an aerosol composition comprising large amount of powder. Japanese unexamined patent publication No. 1999-300242 discloses an aerosol product of which quantitative room has a cavity for holding to always hold powder.

However, the above mentioned prior arts have problems that long time is required for one spraying operation from initiation to termination, namely, for spraying all amount of the aerosol composition in the quantitative room, and that the aerosol composition, particularly powder remains in the quantitative room so that quantitative spraying becomes impossible.

Investigations are made to solve the above mentioned problems and reach the following findings. The above mentioned prior arts use a quantitative spraying valve system leading powder to cake in the quantitative room filled with an aerosol composition, the content of which cannot be stirred by shaking the aerosol product before using. Therefore, in a spraying operation, the powder is not finely divided causing high flow resistance in a passage, and are not easily sprayed. The aerosol composition in a quantitative room is shut out from the interior of the aerosol container, is not added with a propellant and is not effected by the pressure in the interior of the aerosol container, and requires long time to be sprayed in all amounts. The object of the present invention is to solve the above-mentioned problems and to provide an aerosol product spraying surely constant amount of an aerosol composition comprising powder.

DISCLOSURE OF INVENTION

The present invention relates to an aerosol product comprising an aerosol container having a container body, an aerosol valve system attached to an opening of the container body, a spraying part attached to the aerosol valve system, a liquid storage part in a passage from the interior of the container body to a nozzle of the spraying part and a valve to shut out the liquid storage part from the interior of the container body with spraying operation; the aerosol container being charged with an aerosol composition comprising a concentrate comprising powder, a liquefied gas and a compressed gas.

The present invention relates to the above mentioned aerosol product, wherein the compressed gas has an Ostwald coefficient of at least 1 to the liquid phase of the liquefied gas at 25° C.

The present invention relates to each of the above mentioned aerosol products, wherein the compressed gas is carbon dioxide and/or dinitrogen monoxide.

BRIEF DESCRIPTION OF DRAWINGS

In FIGS. 1 to 4, the numeral 1 shows a container body, 2 an aerosol valve system, 3 a nozzle, 4 a spraying part, 5 a liquid storage part, 6 a valve, 7 a housing, 8 a stem, 9 a spring, 10 a stem gasket, 10*a* an inner surface, 11 an inner cock, 12 a cover cap, 13 a bottom wall, 14 an inner cylindrical part, 15 a bush, 16 a dipping tube, 17 a spraying passage, 18 a communicating orifice, 19 a stirring mean, 20 a mounting cup, 21 an opening, 22 a bead part, 23 a gasket, 24 an aerosol composition, and 25 powder.

BEST MODE FOR CARRING OUT THE INVENTION

Figure 1:
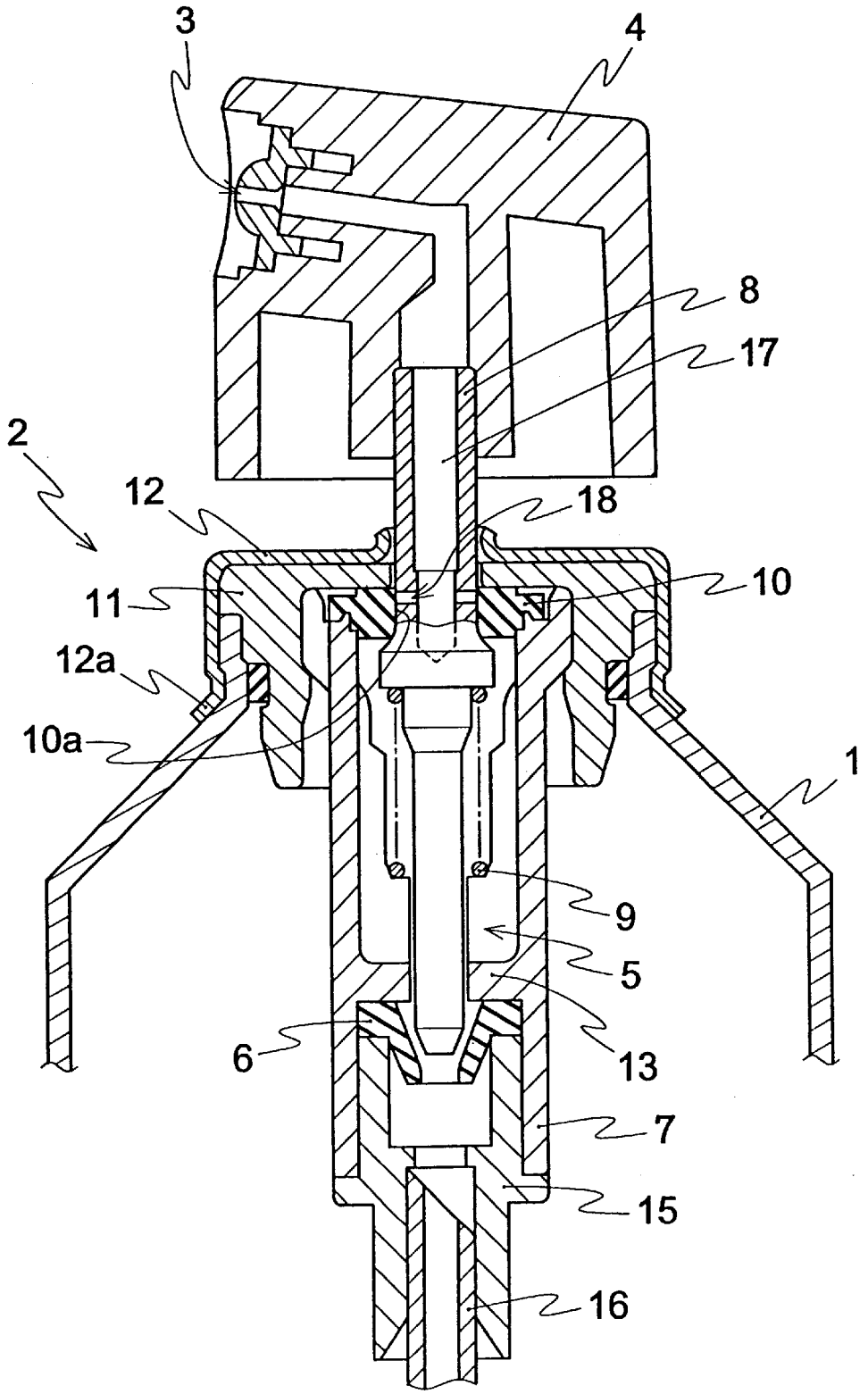
FIG. 1 is a sectional view of a main part of an aerosol container used in an embodiment of the present invention.
Figure 2:
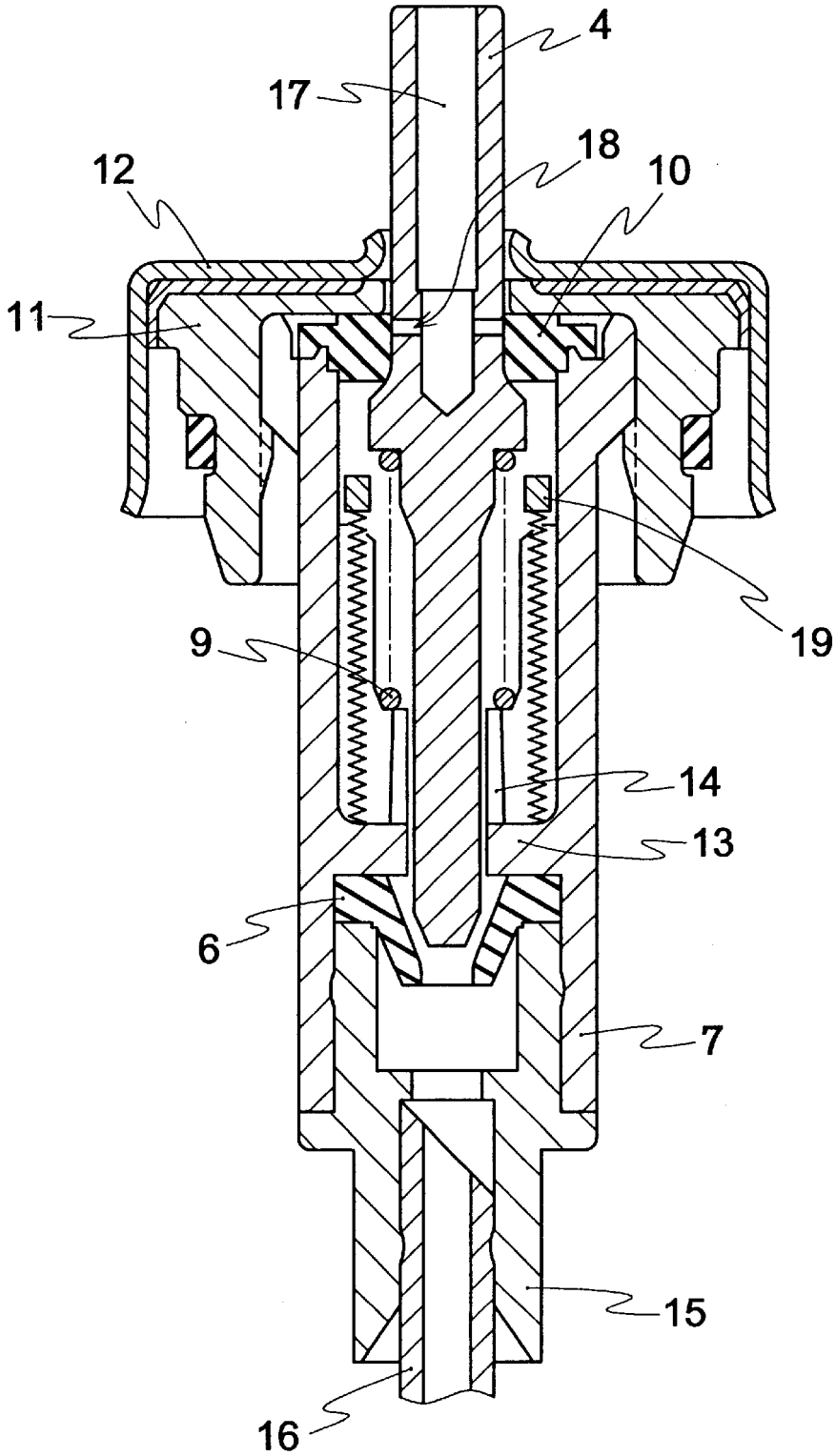
FIG. 2 is a sectional view of a main part of an aerosol container used in an embodiment of the present invention.
Figure 3:
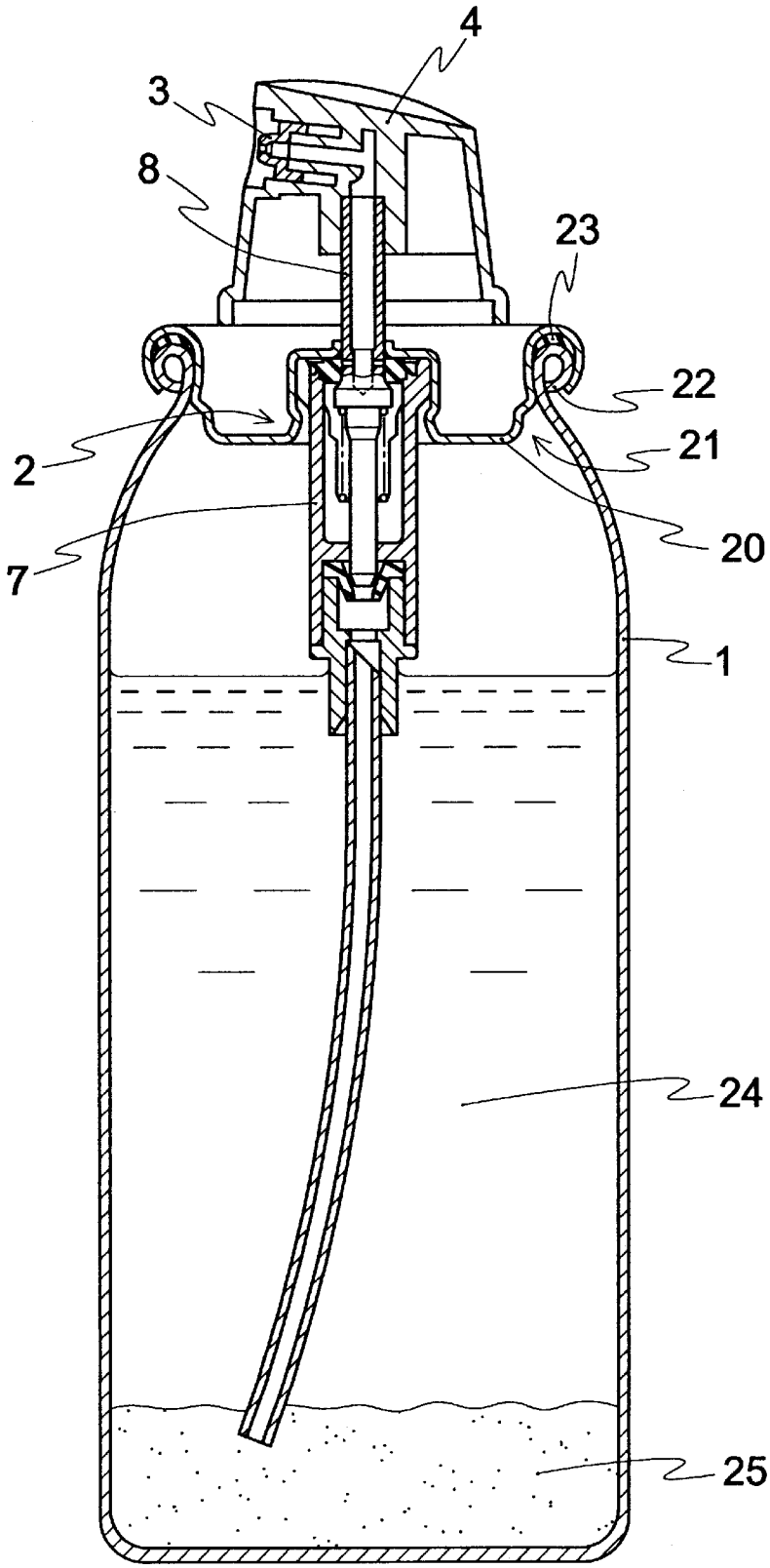
FIG. 3 is a sectional view of an aerosol container used in an embodiment of the present invention.

FIG. 1 shows a sectional view of a main part of an aerosol container used in an embodiment of the present invention. FIG. 2 shows a sectional view of a main part of an aerosol container used in another embodiment of the present invention. FIG. 3 shows a sectional view of an aerosol container used in an embodiment of the present invention.

An aerosol container used in the present invention comprises a container body 1 to be charged with an aerosol composition; an aerosol valve system 2 attached to an opening of the container body 1 to open/close between the interior and the exterior of the container body 1; and a spraying part 4 with a nozzle 3 for spraying the aerosol composition, and further comprises a liquid storage part 5 and a valve 6 to shut out the liquid storage part 5 from the interior of the container body 1 with spraying operation in a passage from the interior of the container body 1 to the nozzle 3 of the spraying part 4.

The aerosol valve system 2 has a housing 7, a stem 8, a spring 9, a stem gasket 10, an inner cock 11 and a cover cap 12.

The housing 7 has cylindrical shape, an upper opening, a bottom opening, a bottom wall 13 dividing the interior space into upper opening side and bottom opening side, and an opening in the central part of the bottom wall 13 connecting the upper opening side and bottom opening side of the interior space and being passed through by a lower part of a stem 8. The aerosol container of FIG. 2 has an inner cylindrical part 14 running upper direction through inside of the opening of the bottom wall 13.

The bottom opening of the housing 7 has a cylindrical bush 15 and a dipping tube 16 one by one. Between the lower surface of the bottom wall 13 and the bush 15, a funnel-like shaped valve 6 having a tip of lip contacting and sliding with outer surface of the lower part of the stem 8.

The stem 8 has an upper opening, and comprises an upper part equipped with a spraying part 4, and a lower part. The lower part of the stem is inserted into the housing 7 and passing through the opening of the bottom wall 13 of the housing 7, and contacts with and seals the valve 6 when the stem 8 is pushed down. The upper opening side part of stem 8 protrudes from the housing 7 to outside, and communicates with the spraying part 4. The stem 8 has the interior space forming a spraying passage 17 and a transversal communicating orifice 18 communicating with the spraying passage 17 on the sidewall. The stem 8 is made of, for example, metal materials such as stainless or synthetic resin materials such as nylon, Juracon, and has a smooth surface to contact sliding with a stem gasket 10.

The stem gasket 10 attached to the outer surface of the stem 8 to contact sliding, in normal condition, closes the communicating orifice 18 of the stem 8 pushed up by pushing force of a spring 9 with the inner surface 10*a* and keeps the sealing of the aerosol container. When spraying, the spraying part 4 is pushed down to release the sealing between the stem gasket 10 and the communicating orifice 18 and to spray the aerosol composition from the nozzle 3 to outside.

The passage for moving the aerosol composition in the aerosol container from interior of the container body 1 to the nozzle 3 can be formed with, for example, the dipping tube 16, the bush 15, the housing 7, the communicating orifice 18 of the stem 8 and the spraying passage 17.

The inner cock 11 holds the housing 7 and is attached to the stem gasket 10. The upper outside of the inner cock 11 is equipped with a cover cap 12. The opening end of the container body 1 is inserted between the inner cock 11 and the cover cap 12, and the lower part 12*a* of the cover cap 12 is fasten and unified to be held.

The aerosol container used in the present invention has a liquid storage part 5 in a passage from the interior of the container body 1 to the spraying nozzle. The aerosol containers of FIGS. 1 to 3 have a liquid storage part 5 as a space formed with the inner surface and the bottom wall 13 of the housing 7, and the communicating orifice 18 closed with the stem gasket 10. In a spraying operation, the lower part of the stem 8 contacts with the valve 6, and shuts out the liquid storage part 5 from the interior of the container body 1.

The liquid storage part 5, in normal condition, communicates to the interior of the aerosol container, and filled densely with the aerosol composition through the dipping tube 16. At use, the spraying part 4 is pushed down in the stem direction, the stem 8 contacts sliding with the stem gasket 10, and the lower part of the stem 8 is inserted to the valve 6 to shut out the liquid storage part 5 from the interior of the container body 1. If the spraying part 4 is further pushed down, the communicating orifice 18 opens. Hence, only the aerosol composition filled in the liquid storage part 5 is introduced to the spraying passage 17 through the communicating orifice 18 and sprayed to outside by the pressure of the propellant. After a spraying operation, if the communicating orifice 18 is closed and the interior of the container body 1 and the liquid storage part 5 communicate each other again, an aerosol composition in the interior of the container body 1 is introduced to the liquid storage part 5 through the dipping tube 16.

The aerosol container used in the invention has spraying property that the aerosol valve system 2 moves shutting out the liquid storage part 5 from the interior of the container body 1 so that the aerosol composition is not provided or pushed by the propellant in the aerosol container and, therefore, is sprayed softly and gently.

In the aerosol container of FIG. 2, the interior surface of the housing 7, the bottom wall 13 and the inside cylindrical part 14 form a cavity for holding powder to store powder and to inhibit powder in the liquid storage part 5 from falling, for example, into the space of the bush 15. The aerosol container in FIG. 2 can have a mean for stirring powder stored in the cavity for holding powder, stirring mean, 19, such as a spring, a ball. The stirring mean 19 can effectively stir powder aggregating closely in the cavity with the structure for stirring inside of the liquid storage part 5 when the aerosol composition is sprayed.

FIG. 3 shows another embodiment of the aerosol container used in the present invention. The aerosol valve system of FIG. 3 has a mounting cup 20 attached to the container body 1 and holding the housing 7. The container body 1 has a bead part 22 at the opening 21, the mounting cup 20 of the aerosol valve system 2 is attached to the bead part 22 through the gasket 23 with tighten. The aerosol container used in the present invention is not limited with the shape and materials of the container body, and the equipping manner of the valve.

The aerosol composition 24 used in the present invention comprises a concentrate comprising powder 25, a liquefied gas and a compressed gas.

The powder, which can be used, may be those having properties of improving the feeling for use, such as dry feeling, when attached to the skin, maintaining the effects by desorption of the adsorbed effective component gradually after attached to the skin, and acting as an effective component.

The content of the powder may be 0.05 to 50% by weight, preferably 0.1 to 30% by weight based on the aerosol composition. Less than 0.05% by weight of powder cannot achieve sufficient effect of the powder. On the other hand, more than 50% by weight tend to make powder cake in the aerosol container, specifically in the liquid storage part leading uniformly spraying to be impossible, and tend to clog easily in the nozzle and the like.

Fine particles can be used are, for example, chlorohydroxyalminium, tolnaphthate, ridocain, chlorohexizine gluconnate, talc, kaolin, mica, sericite, magnesium carbonate, calcium carbonate, silica, magnesium silicate, aluminum silicate, magnesium aluminate metasilicate, zeolite, calcium sulfate, hydroxyapatite, ceramic powder, boron nitride, molybdenum disulfide, polyamide resin powder, polyethylene powder, polystyrene powder, poly (methyl methacrylate) powder, cellulose powder, silicone resin powder, titanium dioxide, iron oxide, pyrite, titanium oxide, carbon black, ultramarine, aluminum powder, copper powder, an effective component powder.

Other components forming the concentrate with the powder can be preferably selected according to objects for use (application). Other components forming the concentrate with powder are, for example, water, oil components, surfactants, alcohol, high molecular weight compounds, and effective components.

Water can be, for example, purified water, ion exchanged water, or the like.

Oil components can be, for example, ester oils such as isopropyl myristate, cetyl octanoate, octyldodecyl myristate, isopropyl palmitate, butyl stearate, myristyl myristate, decyl oleate, cetyl lactate, isocetyl stearate, isocetyl isostearate, diisobutyl adipate, and diisopropyl sebacate; silicones such as dimethyl polysiloxane, methyl phenyl polysiloxane, methyl hydrogen polysiloxane, and decamethyl polysiloxane; hydrocarbons such as kerosene, paraffin, liquid paraffin, vaseline, squarane, aqualene, n-pentan, isopentan, n-hexane, and isohexane; fats and oils such as avocado oil, tsubaki oil, turtle oil, corn oil, mink oil, olive oil, rape seed oil, sesame oil, castor oil, linseed oil, safflower oil, jojoba oil, and coconut oil; wax such as beeswax, lanolin, lanolin acetate, candelilla wax, carnauba wax, montan wax; higher fatty acids such as lauric acid, myristic acid, palmitic acid, stearic acid, behenic acid, oleic acid, isostearic acid, linoleic acid, and linolenic acid.

Surfactants can be, for example, sorbitol fatty acid ester, glycerin fatty acid ester, decaglycerin fatty acid ester, polyglycerin fatty acid ester, polyoxyethylene sorbitol fatty acid ester, polyoxyethylene sorbit fatty acid ester, polyoxyethylene glycelol fatty acid ester, polyethyleneglycol fatty acid ester, polyoxyethylene alkylether, polyoxyethylene polyoxypropylene alkylether, polyoxyethylene alkyl phenyl ether, polyoxyethylene castor oil-hardened castor oil, polyoxyethylene lanolin-lanolin alcohol, beeswax derivatives, polyoxyethylenealkylamine-fatty acid amide, and lecithin.

Alcohol can be, for example, monohydric lower alcohol such as ethanol, propanol, isopropanol; monohydric higher alcohol such as lauryl alcohol, cetyl alcohol, stearyl alcohol, behenyl alcohol, myristyl alcohol, oleyl alcohol, lanolin alcohol, hexyldodecanol, isostearylalcohol; polyhydric alcohol such as ethylene glycol, propylene glycol, 1,3-butylene glycol, diethylene glycol, polypropylene glycol, glyceline, diglyceline, polyethylene glycol, ethylene glycol monoethyl ether, ethylene glycol monobutyl ether, ethylene glycol dimethyl ether, diethylene glycol monoethyl ether, diethylene glycol monobutyl ether, propylene glycol monoethyl ether, ethylene glycol monoethyl ether acetate, diethylene glycol monoethyl ether acetate.

High molecular weight compounds can be, for example, casein, gelatin, starch, methyl cellulose, ethyl cellulose, hydroxyethyl cellulose, denatured potato starch, corn starch, polyvinyl alcohol, carboxy vinyl polymer.

Effective components can be perspiration inhibitors such as chlorohydroxyalminium, zinc oxide, zinc paraphenolsulfonate; deodorants such as lauryl acid methacrylate, methyl benzoate, methyl phenyl acetate, granylchlotorate, acetophenone myristate, benzyl acetate, benzyl propionate; germicidal and antiseptic agents such as paraoxybenzoic ester, sodium benzoate, potassium sorbate, phenoxyethanol, chlorobenzalconium, chlorobenzetonium, chlorochlorohexizine, sensitizing element, parachloromethacresol; refrigerants such as 1-mentol, camphor; astringents such as allantoin hydroxy alminium, citric acid, lactic acid, zinc oxide, tannic acid; inflammation inhibitors such as allantoin, glycyrrhetinic acid, azulene; asthma inhibitors such as metaprotenol, aminophylline, theophylline, telbutalline, adrenaline, ephedrine; sweeteners such as saccharin, aspartame; local narcotics such as dibucaine hydrochloride, tetracaine hydrochloride, lidocaine hydrochloride; antihistamic agents such as diphenhydramine hydrochloride, chlorophenylamine maleate; antiinflammation painkillers such as methyl salicylate, ketoprophene, indometacin, felbinak, pyroxycam, camphor, diphenhydramine, chlotamiton; harmful insect repellents such as N,N-diethyl-m-toluamide (DEET), caprylic acid diethylamide; cosmetic whiteners such as arbutin, kijic acid; ultraviolet rays absorbents such as paraaminobenzoic acid ester, octyl salicylate, phenyl salicylate, isopropyl paramethoxycinnamate, octyl paramethoxycinnamate, 2-ethylhexyl paramethoxy cinnamate, 2,4-dihidoroxybenzophenone, 2-hydroxy-4-methoxybenzophenone; amino acids such as glycine, alanine, leucine, isoleucine, serine, threonine, tryptophan, cystine, cysteine, aspartic acid, glutamic acid; vitamins such as vitamin A oil, retinol, retinyl palmitate, chloropyridoxine, benzyl nicotinate, nicotinic acid amide, d,l-α-tocopheryl nicotinate, vitamin D2 (ergocalciferol), dl-α-tocopherol, d,l-α-tocopheryl acetate, pantothenic acid, biotin; hormones such as elastoradiol, ethynyl estoradiol; antioxidant such as α-tocopherol, dibutyl hydroxy toluene, butyl hydroxy anisole; extracts such as houttunia cordata extract, plantain extract, peony extract, sponge gourd, cinchona (kina) extract, primrose extract, rose extract, lemon extract, aloe extract, sweet flag root extract, eucalyptus extract, sage extract, tea extract, seaweed extract, placental protein, silk extract; various kinds of perfumes.

In the present invention, characteristically a liquefied gas and a compressed gas are used in combination as propellants, and all amount of the aerosol composition comprising powder in the liquid storage part is sprayed. The liquid storage part is shut out from the interior of the aerosol container and is not influenced by the pressure in the interior of the aerosol container. In a spraying operation, a compressed gas dissolved in the concentrate and the liquefied gas in the liquid storage part vaporizes to form bubbles and generate vibration to activate the aerosol composition in the liquid storage part leading the liquefied gas to easily vaporize. Particularly, if the used compressed gas has an Ostwald coefficient (25° C.) of at least 1 to the liquid phase of the liquefied gas, the dissolved amount in the concentrate and the liquefied gas is increased and, when the dissolved compressed gas vaporizes, the aerosol composition in the liquid storage part is activated more strongly and sprayed further surely.

The Ostwald coefficient of a compressed gas to the liquid phase of a liquefied gas can be measured as follows. Aluminum container having the capacity of 100 ml and equipped with an aerosol valve system is charged with a liquefied gas to be occupied by the liquid phase of the liquefied gas in 60% by volume of the capacity. The pressure is represented by $P_{LPG}$, the volume of the liquid phase by $V_l$, the volume of the gas phase by $V_g$. It is considered that $P_{LPG}$, $V_l$ and $V_g$ do not change with the charging and dissolving of the compressed gas. The container is charged with a compressed gas and stored in a thermostatic water bath at 25° C. to show equilibrium pressure. When the amount of the filled compressed gas is represented by a (ml), the measured equilibrium pressure is represented by P (atm) (wherein $P=P_{LPG}+P_{eq}$, $P_{eq}$ is partial pressure of the compressed gas at equilibrium state), and the Ostwald coefficient of the compressed gas to the liquid phase of the liquefied gas is represented by β, the following equation is formed.

$$a=V_g\times P_{eq}+\beta\times V_l\times P_{eq}$$

Hence, β is calculated by the following equation.

$$\beta=(a-V_g\times P_{eq})\div(V_l\times P_{eq})$$

For example, Ostwald coefficients (ml/ml) of carbon dioxide to various liquefied gases at 25° C. are 2.5 to n-butane, 2.8 to isobutane, 2.8 to LPG (0.2), 2.6 to LPG (0.3), and 9.7 to dimethylether. LPG (0.2) represents a mixture of n-butane and isobutane having the vapor pressure of 0.2 MPa at 25° C. LPG (0.3) represents a mixture of n-butane, isobutane and propane having the vapor pressure of 0.3 MPa at 25° C.

The liquefied gas can be liquefied petroleum gas (propane, n-butane, isobutane or a mixture thereof), dimethylether, flon such as tetrafluoroethane, or heptafluoropuropane, and a mixture thereof. The liquefied gas preferably has a vapor pressure at 25° C. of 0.1 to 0.6 MPa, particularly 0.15 to 0.5 MPa. When the vapor pressure is less than 0.1 MPa, the aerosol composition in the liquid storage part becomes difficult to be sprayed in all amount. When the vapor pressure is more than 0.6 MPa, the force of spraying becomes strong to decline the feeling for use. The liquefied gas can be mixed with a hydrocarbon having 5 to 6 carbon atoms such as n-pentane, isopentane, n-hexane to adjust pressure to be desired.

The compressed gas can be carbon dioxide gas, nitrogen gas, dinitrogen monoxide gas, compressed air and a mixture thereof. Among the compressed gas, that having an Ostwald coefficient of at least 1 to the liquid phase of the liquefied gas is preferable, such as carbon dioxide gas, dinitrogen monoxide gas. A mixture of a compressed gas having a large value of an Ostwald coefficient such as carbon dioxide or dinitrogen monoxide gas and others such as nitrogen gas, or compressed air can be used, said mixture having an Ostwald coefficient of at least 1. When the compressed gas has an Ostwald coefficient of less than 1 to the liquid phase of the liquefied gas, the compressed gas is issolved in small amount to make the aerosol composition in the liquid storage part active insufficiently and difficult to be sprayed in all amount.

The liquefied gas is blended in an amount of 30 to 99% by weight, preferably 40 to 97% by weight of the aerosol composition. When the amount of the liquefied gas is less than 30% by weight, the aerosol composition in the liquid storage part is difficult to be sprayed surely in all amount and to be used. When the amount of the liquefied gas is more than 99% by weight, the desirable effect cannot be obtained because the amount of active components, powder, compressed gas or the like is decreased.

The compressed gas is blended in an amount of 0.1 to 10% by weight, preferably 0.5 to 10% by weight. When the amount of the compressed gas is less than 0.1% by weight, the compressed gas is dissolved in small amount requiring long time to spray the aerosol composition in the liquid storage part in all amount and make the product difficult to be used. When the amount of the compressed gas is more than 10% by weight, the pressure of the product is excessively increased to a dangerous degree.

The aerosol product of the present invention can be obtained by charging the above mentioned aerosol container with the above mentioned aerosol composition. The aerosol product of the present invention is useful for applications, for example, products for human organism such as an ointment, an antipruritic, a medicine for athlete's foot, a drug for asthma, a disinfectant, an anti-inflammatory-analgesic, an antiperspirant, a repellent for a harmful insect, a face lotion, a pre-shaving lotion, an after-shaving lotion, and a sun-screen agent; products for hair or scalp such as a hair spray, a hair foam, a hair treatment foam, a cream foam, a foam wax, a hair dye, a hair growing agent, a decolorant, and a cleansing.

EXAMPLES 1 to 3 AND COMPARATIVE EXAMPLE 1

An aerosol container made of aluminum and having a capacity of 80 ml, shown in FIG. 1, was charged with 30 g of an aerosol composition comprising 14.0% by weight of a concentrate consisting of chloro hydroxy aluminiun of 3.0% by weight, talc of 6.0% by weight, zinc oxide of 1.0% by weight, isopropyl myristate of 3.0% by weight, sorbitan monooleate of 0.5% by weight, and dimethyl polysiloxane of 0.5% by weight. The composition further comprised 82.0% by weight of a liquefied gas and 4.0% by weight of carbon dioxide in Example 1, 84.0% by weight of a liquefied gas and 2.0% by weight of carbon dioxide in Example 2, 85.0% by weight of liquefied gas and 1.0% by weight of carbon dioxide in Example 3, or 86.0% by weight of liquefied gas in Comparative Example 1.

The capacity of the liquid storage part was 1 ml. In Examples 1 and 2, and Comparative Example 1, a mixture of n-butane and isobutane having a vapor pressure of 0.2 MPa at 25° C. (LPG (0.2)) was used as the liquefied gas. In Example 3, a mixture of n-butane, isobutane and propane having a vapor pressure of 0.3 MPa at 25° C. (LPG (0.3)) was used.

EXAMPLES 4 to 6 AND COMPARATIVE EXAMPLE 2

An aerosol container made of aluminum and having the capacity of 100 ml, shown in FIG. 3, was charged with 40 g of an aerosol composition, an ointment, comprising 10.54% by weight of a concentrate consisting of zinc oxide of 0.5% by weight, talc of 3.0% by weight, acrynol of 0.01% by weight, lidocaine of 0.02% by weight, dipotassium glycyrrhetinate of 0.01% by weight, and isopropyl myristate of 7.0% by weight. The composition further comprised 84.46% by weight of LPG (0.2) and 5.0% by weight of carbon dioxide in Example 4, 76.46% by weight of LPG (0.2), 10.0% by weight of dimethyl ether and 3.0% by weight of carbon dioxide in Example 5, 86.16% by weight of LPG (0.2), 3.0% by weight of carbon dioxide and 0.3% by weight of nitrogen gas in Example 6, or 89.46% by weight of LPG (0.2) in Comparative Example 2.

EXAMPLE 7 AND COMPARATIVE EXAMPLE 3

A fine powder was obtained by spray drying method from a solution of 1968 mg of aminophylline, 2 mg of soybean lecithin, and 30 mg of aspartame in 30% ethanol aqueous solution. An aerosol container made of aluminum and having the capacity of 20 ml, shown in FIG. 1, was charged with an aerosol composition, a medicine for asthma, comprising 15 mg of the fine powder, 10 g of heptafluoropropane and 0.3 g of carbon dioxide. The capacity of the liquid storage part was 0.1 ml. In Comparative Example 3, an aerosol container made of aluminum and having the capacity of 20 ml, shown in FIG. 1, was charged with an aerosol composition comprising 15 mg of the above mentioned fine powder and 10 g of heptafluoropropane.

Evaluation (1) Stability of Sprayed Amounts

Figure 4:
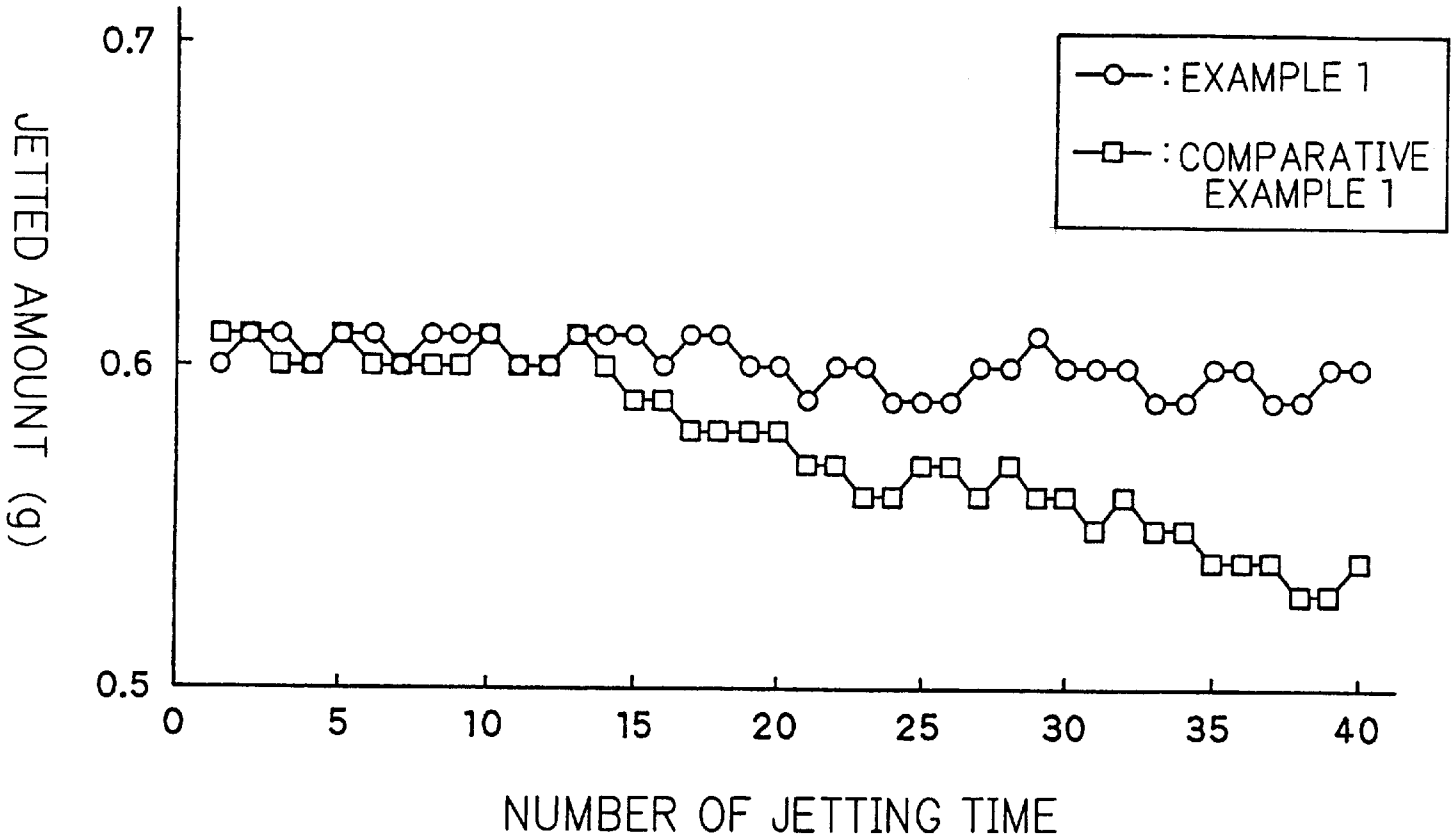
FIG. 4 is a graph showing a result, stability of sprayed amounts, of Examples of the present invention.

The aerosol products of Example 1 and Comparative Example 1 was placed in thermostatic water bath at 25° C. for 30 min before spraying. A sprayed amount was calculated from measured weights before and after spraying. The operation was repeated 40 times to evaluate the stability of sprayed amounts. Results of sprayed amount (g) are shown in Table 1 and FIG. 4.

TABLE 1

| Jetting time No. | Example 1 | Comparative Example 1 |
|---|---|---|
| 1 | 0.60 | 0.61 |
| 2 | 0.61 | 0.61 |
| 3 | 0.61 | 0.60 |
| 4 | 0.60 | 0.60 |
| 5 | 0.61 | 0.61 |
| 6 | 0.61 | 0.60 |
| 7 | 0.60 | 0.60 |
| 8 | 0.61 | 0.60 |
| 9 | 0.61 | 0.60 |
| 10 | 0.61 | 0.61 |
| 11 | 0.60 | 0.60 |
| 12 | 0.60 | 0.60 |
| 13 | 0.61 | 0.61 |
| 14 | 0.61 | 0.60 |
| 15 | 0.61 | 0.59 |
| 16 | 0.60 | 0.59 |
| 17 | 0.61 | 0.58 |
| 18 | 0.61 | 0.58 |
| 19 | 0.60 | 0.58 |
| 20 | 0.60 | 0.58 |
| 21 | 0.59 | 0.57 |
| 22 | 0.60 | 0.57 |
| 23 | 0.60 | 0.56 |
| 24 | 0.59 | 0.56 |
| 25 | 0.59 | 0.57 |
| 26 | 0.59 | 0.57 |
| 27 | 0.60 | 0.56 |
| 28 | 0.60 | 0.57 |

TABLE 1-continued

| Jetting time No. | Example 1 | Comparative Example 1 |
|---|---|---|
| 29 | 0.61 | 0.56 |
| 30 | 0.60 | 0.56 |
| 31 | 0.60 | 0.55 |
| 32 | 0.60 | 0.56 |
| 33 | 0.59 | 0.55 |
| 34 | 0.59 | 0.55 |
| 35 | 0.60 | 0.54 |
| 36 | 0.60 | 0.54 |
| 37 | 0.59 | 0.54 |
| 38 | 0.59 | 0.53 |
| 39 | 0.60 | 0.53 |
| 40 | 0.60 | 0.54 |

The same experiments were conducted for Examples 2 to 7, and Comparative Examples 2 and 3. The aerosol products showing a reduction ratio of a sprayed amount of less than 5% were evaluated as "A", those showing 5 to 10% were as "B", and those showing more than 10% were as "C" based on the average of values of 1st to 5th of spraying times. The results are shown in Table 2.

(2) Feeling for Use

Feeling for use at spraying on skin was evaluated according to the following criterion.

A: sprayed in a soft form, flying off in low amount on the skin, and requiring short time for the spraying to stop.

B: Requiring long time for the spraying to stop and being difficult to be used.

TABLE 2

| | Stability of sprayed amounts | Feeling for use |
|---|---|---|
| Example No. | | |
| 1 | A | A |
| 2 | A | A |
| 3 | A | A |
| 4 | A | A |
| 5 | A | A |
| 6 | A | A |
| 7 | A | A |

TABLE 2-continued

| | Stability of sprayed amounts | Feeling for use |
|---|---|---|
| Comparative Example | | |
| 1 | C | B |
| 2 | C | B |
| 3 | C | B |

The experiment results show that the aerosol products of the present invention, Examples 1 to 7, can spray constant amount of a composition repeatedly, and superior in the feeling for use, and that aerosol products of prior arts, Comparative Examples 1 to 3, show reduction of sprayed amount remarkably and cannot spray constant amount of a composition. The prior arts required long time for one spraying and were inferior in feeling for use.

INDUSTRIAL APPLICABILITY

The aerosol product of the present invention can spray surely a constant amount of an aerosol composition comprising powder.

What is claimed is:

1. An aerosol product comprising an aerosol container having a container body, an aerosol valve system attached to an opening of the container body, a spraying part attached to the aerosol valve system, a liquid storage part in a passage from the interior of the container body to a nozzle of the spraying part and a valve to shut out the liquid storage part from the interior of the container body with spraying operation; said aerosol container being charged with an aerosol composition comprising a concentrate comprising powder, a liquefied gas and a compressed gas.

2. The aerosol product of claim 1, wherein the compressed gas has an Ostwald coefficient of at least 1 to the liquid phase of the liquefied gas at 25° C.

3. The aerosol product of claim 1, wherein the compressed gas is carbon dioxide and/or dinitrogen monoxide.

4. The aerosol product of claim 2, wherein the compressed gas is carbon dioxide and/or dinitrogen monoxide.

* * * * *

UNITED STATES PATENT AND TRADEMARK OFFICE

CERTIFICATE OF CORRECTION

PATENT NO. : 6,581,807 B1
DATED : June 24, 2003
INVENTOR(S) : S. Mekata

It is certified that error appears in the above-identified patent and that said Letters Patent is hereby corrected as shown below:

Column 7,
Line 8, please cancel "issolved" and substitute -- dissolved -- therefor.

Signed and Sealed this

Fourteenth Day of October, 2003

JAMES E. ROGAN
*Director of the United States Patent and Trademark Office*